US006942045B2

(12) United States Patent
Dennis

(10) Patent No.: US 6,942,045 B2
(45) Date of Patent: Sep. 13, 2005

(54) DRILLING WITH MIXED TOOTH TYPES

(75) Inventor: John G. Dennis, Lakewood, CO (US)

(73) Assignee: Halliburton Energy Services, Inc., Carrollton, TX (US)

( * ) Notice: Subject to any disclaimer, the term of this patent is extended or adjusted under 35 U.S.C. 154(b) by 6 days.

(21) Appl. No.: 10/325,650

(22) Filed: Dec. 19, 2002

(65) Prior Publication Data

US 2004/0118609 A1 Jun. 24, 2004

(51) Int. Cl.[7] ..... E21B 10/16

(52) U.S. Cl. ..... 175/378; 175/341; 175/374; 175/426

(58) Field of Search ..... 175/57, 378, 341, 175/374, 426, 434, 431, 331

(56) References Cited

U.S. PATENT DOCUMENTS 4,940,099 A * 7/1990 Deane et al. ..... 175/374
5,372,210 A * 12/1994 Harrell ..... 175/431
5,839,526 A * 11/1998 Cisneros et al. ..... 175/431
5,880,382 A * 3/1999 Fang et al. ..... 75/236
6,095,262 A * 8/2000 Chen ..... 175/57
6,161,634 A * 12/2000 Minikus et al. ..... 175/331
6,176,329 B1 * 1/2001 Portwood et al. ..... 175/341
6,213,225 B1 * 4/2001 Chen ..... 175/57
6,241,035 B1 * 6/2001 Portwood ..... 175/374
6,361,873 B1 * 3/2002 Yong et al. ..... 428/469
6,401,839 B1 * 6/2002 Chen ..... 175/57
6,527,068 B1 * 3/2003 Singh et al. ..... 175/431
6,615,935 B2 * 9/2003 Fang et al. ..... 175/374

* cited by examiner

*Primary Examiner*—David Bagnell
*Assistant Examiner*—Shane Bomar
(74) *Attorney, Agent, or Firm*—Groover & Holmes; Robert O. Groover; Patrick C. R. Holmes

(57) ABSTRACT

A rotary-cutter Earth-penetrating bit in which a given track of bottom hole is attacked by inserts of two different types, e.g. chisel-shaped and pointed, wider and narrower, higher and shorter, and/or of different materials. The different types of inserts can both be included within a single row of a cone.

7 Claims, 4 Drawing Sheets

DRILLING WITH MIXED TOOTH TYPES

BACKGROUND AND SUMMARY OF THE INVENTION

The present invention relates to earth-penetrating drill bits, and particularly to rotary-cone rotating bits such as are used for drilling oil and gas wells.

Background: Rotary Drilling

Oil wells and gas wells are drilled by a process of rotary drilling. In a conventional drill rig, as seen in FIG. 5 a drill bit 50 is mounted on the end of a drill string 52, made of many sections of drill pipe, which may be several miles long. At the surface a rotary drive turns the string, including the bit at the bottom of the hole, while drilling fluid (or "mud") is pumped through the string by very powerful pumps 54.

The bit's teeth must crush or cut rock, with the necessary forces supplied by the "weight on bit" (WOB) which presses the bit down into the rock, and by the torque applied at the rotary drive. While the WOB may in some cases be 100,000 pounds or more, the forces actually seen at the drill bit are not constant: the rock being cut may have harder and softer portions (and may break unevenly), and the drill string itself can oscillate in many different modes. Thus the drill bit must be able to operate for long periods under high stresses in a remote environment.

When the bit wears out or breaks during drilling, it must be brought up out of the hole. This requires a process called "tripping": a heavy hoist pulls the entire drill string out of the hole, in stages of (for example) about ninety feet at a time. After each stage of lifting, one "stand" of pipe is unscrewed and laid aside for reassembly (while the weight of the drill string is temporarily supported by another mechanism). Since the total weight of the drill string may be hundreds of tons, and the length of the drill string may be tens of thousands of feet, this is not a trivial job. One trip can require tens of hours and is a significant expense in the drilling budget. To resume drilling the entire process must be reversed. Thus the bit's durability is very important, to minimize round trips for bit replacement during drilling.

Background: Drill Bits

One of the most important types of rotary drill bits commonly used in drilling for oil and gas is the roller cone bit, seen in FIG. 6. In such bits, a rotating cone 82 with teeth 84 on its outer surface is mounted on an arm 46 of the drill bit body. The arms 46 (typically three) extend downhole from the bit body, and each carries a spindle on which the cone is mounted with heavy-duty bearings. The support arms are roughly parallel to the drill string, but the spindles are angled to point radially inward and downhole.

As the drill bit rotates, the roller cones roll on the bottom of the hole. The weight-on-bit forces the downward pointing teeth of the rotating cones into the formation being drilled, applying a compressive stress which exceeds the yield stress of the formation, and thus inducing fractures. The resulting fragments are flushed away from the cutting face by a high flow of drilling fluid.

The drill string typically rotates at 150 rpm or so, and sometimes as high as 1000 rpm if a downhole motor is used, while the roller cones themselves typically rotate at a slightly higher rate. At this speed the roller cone bearings must each carry a very bumpy load which averages a few tens of thousands of pounds, with the instantaneous peak forces on the bearings several times larger than the average forces. This is a demanding task.

Background: Selection of Insert Shapes

A wide variety of shapes have been used for the inserts of roller-cone-type bits. These include, for example, hemispherical inserts, where the exposed surface is generally spherical; pointed inserts, which are also axisymmetric but rise higher, for a given insert diameter, than hemispherical inserts would; chisel-shaped inserts, having a "crest" orientation; and more complex shapes. Insert design and selection is itself a complex and highly developed area of engineering.

Proper insert selection depends on the formation being drilled. Very hard formations will typically be drilled with hemispherical inserts; sandstone formations will typically use pointed inserts; and shaly formations will commonly use chisel-shaped inserts.

Drilling with Mixed Tooth Types

The present application discloses bits, rigs, and methods for rock penetration, using different types of teeth for a single bottomhole track.

For example, in one class of embodiments, a single row of one or more cones contains both pointed inserts and chisel-shaped inserts.

In another class of embodiments, the same bottomhole track is attacked by inserts of different diameters. (For example, a single non-gage row of a single cone can include inserts of different diameters.)

In another class of embodiments, the same bottomhole track is attacked by inserts of different heights. (For example; a single non-gage row of a single cone can include inserts which protrude upward to different heights.) This can advantageously be implemented, for example, using larger-diameter inserts for the ones which have greater protrusion from the cone.

In another class of embodiments, the same bottomhole track is attacked by inserts of different materials. (For example, a single row of a single cone can include inserts with different carbide compositions.) One particularly advantageous implementation of this is to combine different carbide compositions with different profiles, so that the inserts with the more "aggressive" profile have a more abrasion-resistant composition, and the inserts with a more "conservative" profile have a more fracture-resistant composition. (Another advantageous implementation is just the opposite, where the inserts with the more "aggressive" profile have a more fracture-resistant composition, and the inserts with a more "conservative" profile have a more abrasion-resistant composition.)

The disclosed innovations, in various embodiments, provide one or more of at least the following advantages, many related to efficiencies:

Physical efficiencies as related to failing multiple types of rock with one cutting structure containing multiple features/shapes/extensions/diameters;

Aggressive as related to addressing multiple types of rock (soft/hard/sandy/shaley/etc) with one cutting structure (containing multiple features/shapes/extensions/diameter);

Durability as related to addressing multiple types of rock (soft/hard/sandy/shaley/etc) with one cutting structure (containing multiple features/shapes/extensions/diameters);

Mechanical efficiencies (WOB/RPM) as related to failing multiple types of rock with one cutting structure (containing multiple features/shapes/extensions/diameters).

A further expected advantage, of some embodiments at least, is improved resistance to secondary tooth fractures induced by a first tooth fracture: when more durable teeth are mixed with less durable teeth, the more durable teeth are expected to be more resistant to secondary fracture.

It should also be noted that the advantages obtained by the disclosed innovations can be used in various ways: for example, increased durability can be traded off for higher ROP in a given formation, or vice versa.

BRIEF DESCRIPTION OF THE DRAWING

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

The present application teaches combination or mixing of different types of inserts—whether shapes, diameters, extensions, and or materials—within the same cone row, within other rows on the same cone, or in conjunction rows on with other cones which impact a shared bottom hole track—in an effort to enhance drilling performance, either by improved rates of penetration or durability or a combination of both. These features can be beneficial in transitional formations, mixed lithology or uniform lithology. By varying the above insert variables in a given row or a combination of rows the crater shape, bottom hole pattern, and or effective insert penetration can be enhanced through extra action on bottom, prefracturing, and/or kerfing the formation, thus combining insert attribute efficiencies to provide performance improvement.

Naturally the intermesh clearances need to be adequate for the insert with the most protrusion in each row, and for the insert with the greatest width.

It is also preferable to check the bit's balance, as described in U.S. Pat. Nos. 6,213,225 and 6,095,262, both of which are hereby incorporated by reference. (Use of multiple tooth types in a single row means that more effort will be required to input the full data needed for the evaluations and optimizations described in these patents, but those procedures are expected to be particularly beneficial in this context.)

Manufacturing confusion is another area where the use of the disclosed inventions may require additional care, so that each insert is placed with exactly the desired DFA, DFB and angle.

A design method which can be useful in connection with these different insert shapes is to maximize insert row clearances to maximize insert diameter, and then altering insert parameters in a give row.

Embodiments Combining Differently-Shaped Inserts

The present application discloses bits, rigs, and methods for rock penetration, using different types of teeth for a single bottomhole track.

First Sample Embodiment

For example, in one class of embodiments, a single row of one or more cones contains both pointed inserts and chisel-shaped inserts. In other classes of embodiments, inserts of different diameters can be combined, or inserts of different heights, or even inserts of different materials.

Figure 1:
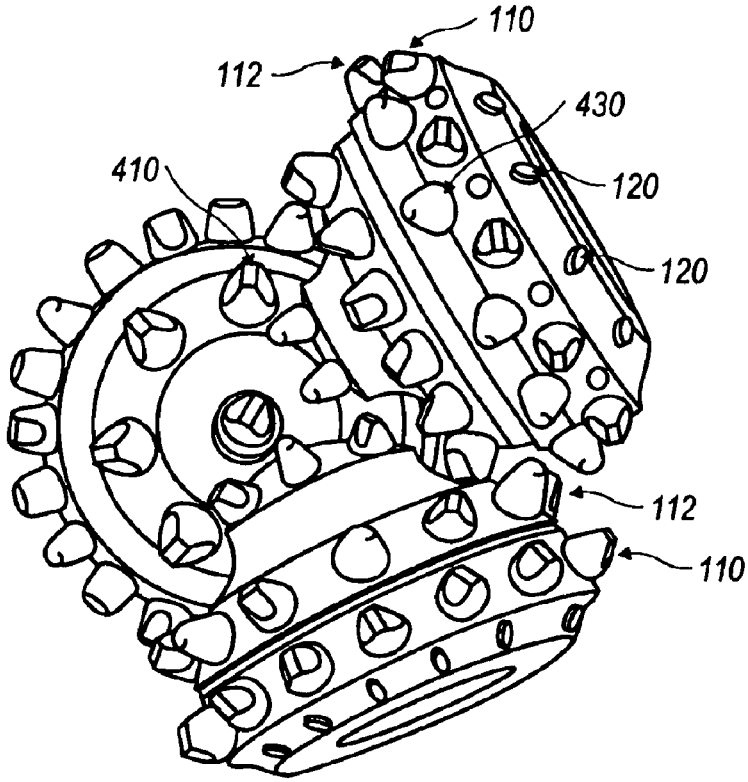
FIGS. 1 and 2 show the cone structure of a first sample embodiment, from two different perspectives.
Figure 2:
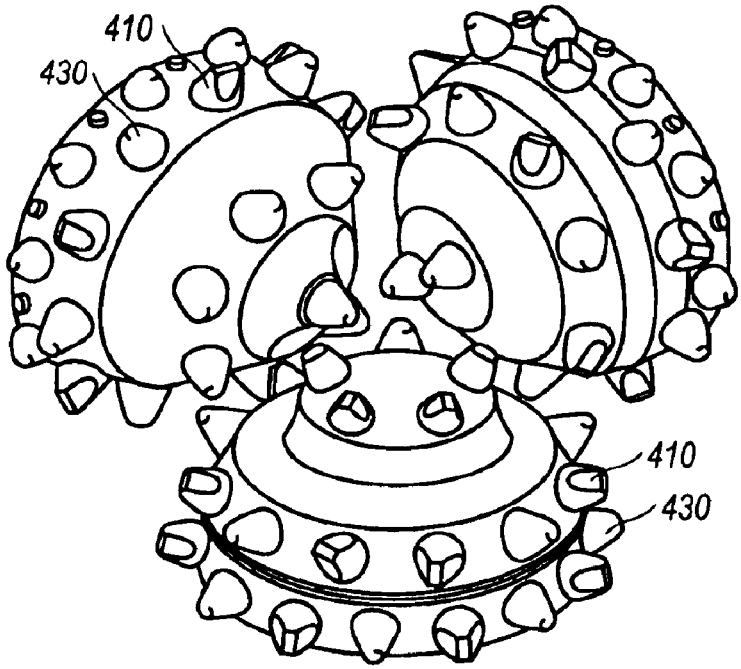

FIGS. 1 and 2 show the cone structure of a first sample embodiment, from two different perspectives. In this embodiment, the alternating conical 410 and chisel shaped inserts 430 in a drive row have the same diameter, are made of the same material, and have the same extension. (As will be obvious to those skilled in the art, the "conical" inserts 410 typically do not have a sharp tip, but have a rounded or spherical tip on a conical base.)

Note that the gage row 110 itself, in this embodiment, does not have a mixture of tooth types. Instead, the driver row 112 (the next row inboard of the gage row), and optionally some of the inner rows, have a mixture of different tooth types.

It is believed that the combination of axisymmetric and chisel-shaped inserts may be particularly synergistic, in that the axisymmetric insert can efficiently initiate failure of rock which is then efficiently removed by the chisel-shaped insert.

Second Sample Embodiment

Figure 3:
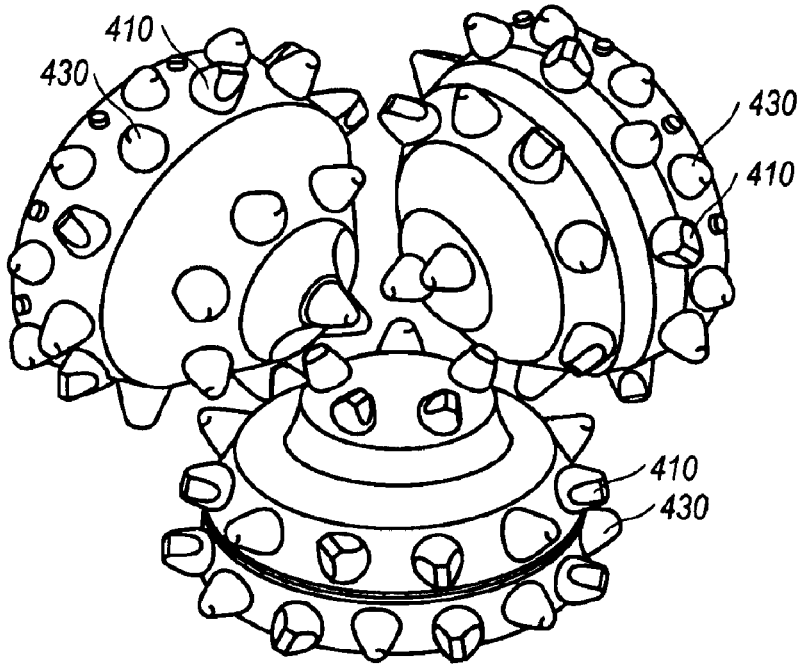
FIG. 3 shows the cone structure of a second sample embodiment. This embodiment also combines conical and chisel-shaped inserts in a single row, but note that the orientations of the chisel-shaped inserts are not the same as in the embodiment of FIGS. 1 and 2.

FIG. 3 shows the cone structure of a second sample embodiment. This embodiment also combines conical and chisel-shaped inserts in a single row, but note that the orientations of the chisel-shaped inserts 410 are not the same as in the embodiment of FIGS. 1 and 2.

Other Mixed-Shape Embodiments

The specific combination of conical- and chisel-shaped inserts is particularly attractive, but many other combinations of different shapes are possible. For example, inserts which have multiple flats, e.g. in an asymmetric shape like that of a cape chisel, can be combined with conical inserts, or which chisel-shaped inserts.

Embodiments Combining Inserts of Unequal Protrusion/Extension

In another class of embodiments, the same bottomhole track is attacked by inserts of different heights. (For example, a single non-gage row of a single cone can include inserts which protrude upward to different heights.) The inserts with higher protrusions (greater heights) can accelerate cutting for as long as they last, which the inserts with lower protrusions provide a more durable and conservative complement.

Figure 4A:
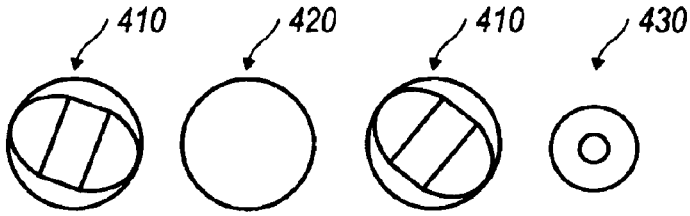
FIGS. 4*a* and 4*b* illustrate some other combinations of different types of teeth in a single row.
Figure 4B:
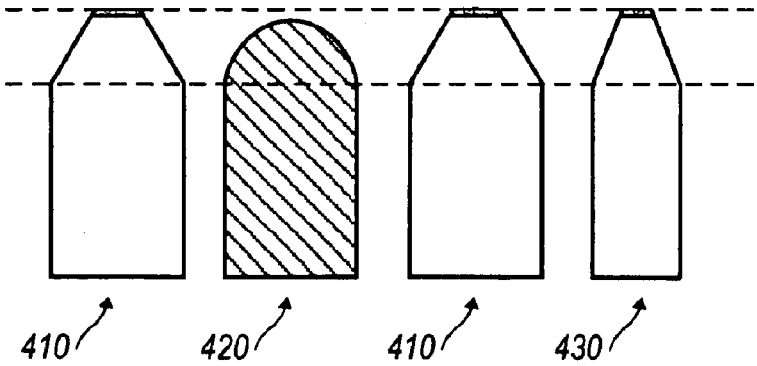
Figure 5:
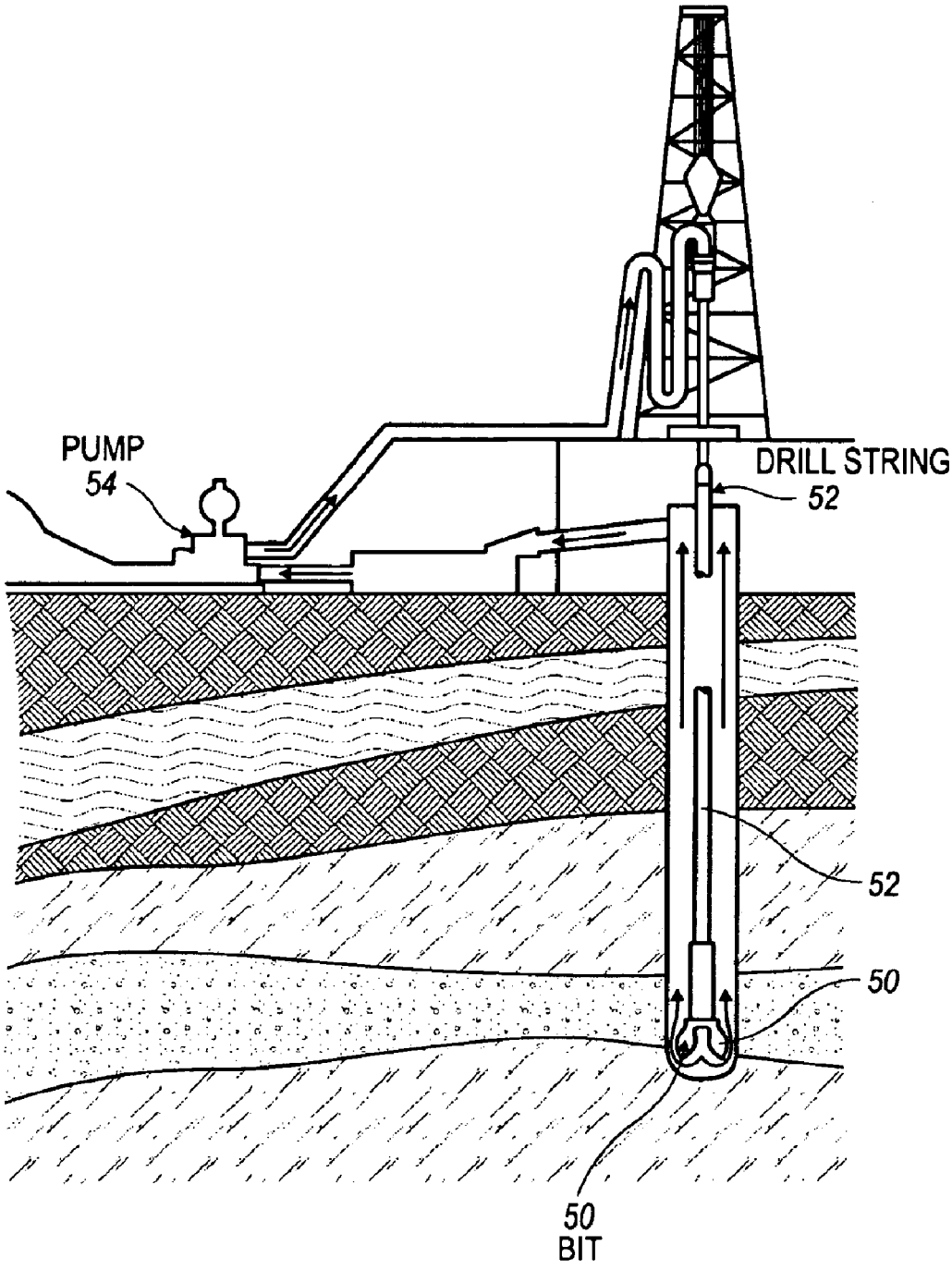
FIG. 5 (PRIOR ART)
FIG. 5 shows an exemplary drill rig.
Figure 6:
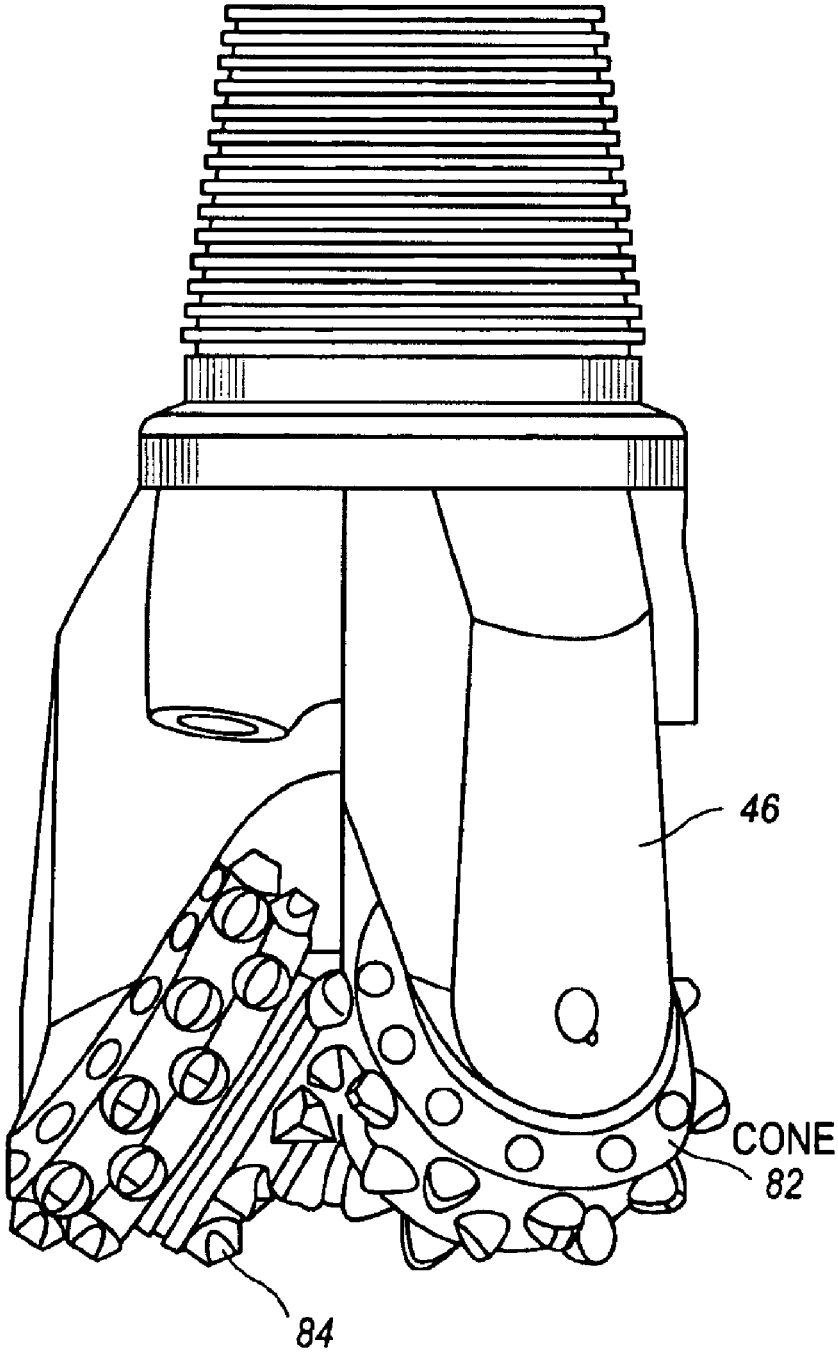
FIG. 6 ( PRIOR ART )
FIG. 6 shows a conventional rotary cone (or "roller-cone") drill bit.

FIGS. 4*a* and 4*b* illustrate some other combinations of different types of teeth in a single row. For simplicity in illustrating the alteration or variation of teeth, the geometry has been transformed so that the inserts are shown in a straight line. Top and section views are given.

In the example shown, a sequence of four teeth is illustrated: chisel-shaped insert 410, low-protrusion large-diameter "fallback" insert 420, another chisel-shaped insert 410, and a conical insert 430 which has the same height as the chisel-shaped inserts 410. In this example the full-height conical insert 430 cooperates with the chisel-shaped inserts 410 to achieve rapid cutting in tractable formations, and the more durable insert 420 provides increased survivability. Preferably, the more durable insert 420 is given a different composition, e.g., of a more abrasion-resistant carbide. Thus, this figure illustrates unequal protrusion (or extension, i.e., height above the surface of the cone), as well as unequal diameters, different materials, and combination of more than two different types in the same row.

Embodiments Combining Inserts of Unequal Diameter

In another class of embodiments, the same bottomhole track is attacked by inserts of different diameters. (For example, a single non-gage row of a single cone can include inserts of different diameters.) This has the advantage that durability can be maximized by large-diameter inserts, without the design inconvenience and crowding which would result from use of large-diameter inserts only.

FIGS. 4*a* and 4*b*, as noted above, illustrate an example of mixed insert diameters.

Embodiments Combining Inserts of Unequal Diameter and Unequal Protrusion

FIGS. 4*a* and 4*b*, as noted above, illustrate an example of mixed insert types where both diameter AND protrusion are different between two of the types. As noted above, this can be a synergistic combination.

The example shown combines a large-diameter low-height insert with a smaller-diameter and greater-protrusion insert. However, the opposite combination can also have advantages: a larger diameter can be given to the insert which has greater protrusion, to reduce the risk of breakage from scraping-related forces.

Embodiments Combining Inserts of Different Materials

In another class of embodiments, the same bottomhole track is attacked by inserts of different materials. (For example, a single row of a single cone can include inserts with different carbide compositions.) One particularly advantageous implementation of this is to combine different carbide compositions with different profiles, so that the inserts with the more "aggressive" profile have a more abrasion-resistant composition, and the inserts with a more "conservative" profile have a more fracture-resistant composition. (Another advantageous implementation is just the opposite, where the inserts with the more "aggressive" profile, have a more fracture-resistant composition, and the inserts with a more "conservative" profile have a more abrasion-resistant composition.)

FIGS. 4*a* and 4*b*, as noted above, illustrate this class of embodiments also: note that insert 420 is hatched differently than the others, to show that it has a different composition.

Combining Inserts of Different Shapes and Different Materials

It is believed that the combination of axisymmetric and chisel-shaped inserts may be particularly synergistic, in that the axisymmetric insert can efficiently initiate failure of rock which is then efficiently removed by the chisel-shaped insert. In this example of differentiated tooth functionality, both compositions and shapes of the two types of teeth can be separately optimized.

In another class of embodiments, the same bottomhole track is attacked by inserts of different materials. (For example, a single row of a single cone can include inserts with different carbide compositions.) One particularly advantageous implementation of this is to combine different carbide compositions with different profiles, so that the inserts with the more "aggressive" profile have a more abrasion-resistant composition, and the inserts with a more "conservative" profile have a more fracture-resistant composition. (Another advantageous implementation is just the opposite, where the inserts with the more "aggressive" profile have a more fracture-resistant composition, and the inserts with a more "conservative" profile have a more abrasion-resistant composition.)

Combining Inserts which Differ in More than Two Ways

In further alternative embodiments, at least two types of teeth can be made different in three or more respects. For example, chisel-shaped teeth which perform scraping in soft formations can optionally be combined with blunt conical teeth with larger diameters and less protrusion, for maximum survivability when hard horizons are encountered.

Combining More than Two Types of Inserts

In further alternative embodiments, it is contemplated that three of more types of inserts can be combined in the same row (or hitting the same bottom-hole track). For example, chisel-shaped teeth which perform scraping in soft formations can optionally be combined with blunt conical teeth with larger diameters and less protrusion, for maximum survivability when hard horizons are encountered.

According to a disclosed class of innovative embodiments, there is provided: A rotary-cutter rock-penetrating drill bit, comprising: a plurality of rotatable elements, each bearing thereon first and second types of cutting elements which incrementally remove rock as the drill bit is rotated and advanced; wherein at least some of said first and second types of cutting elements remove rock from a shared bottom-hole location, and wherein said first and second types of cutting elements are differently optimized for different respective formation types.

According to another disclosed class of innovative embodiments, there is provided: A rotary-cutter rock-penetrating drill bit, comprising: a plurality of cutting elements which incrementally remove rock from a cutting face as the drill bit is rotated and advanced; wherein at least one track of said cutting face is impinged on by first and second types of said cutting elements having different shapes.

According to another disclosed class of innovative embodiments, there is provided: A rotary-cutter rock-penetrating drill bit, comprising: a plurality of cutting elements which incrementally remove rock from a cutting face as the drill bit is rotated and advanced; wherein at least one track of said cutting face is impinged on by first and second different types of said cutting elements, wherein said first type is more axisymmetric than said second type.

According to another disclosed class of innovative embodiments, there is provided: A rotary-cutter rock-penetrating drill bit, comprising: a plurality of cutting elements which incrementally remove rock from a cutting face as the drill bit is rotated and advanced; wherein at least one track of said cutting face is impinged on by first and second types of said cutting elements, and wherein cutting elements of said first type protrude deeper into said cutting face than said elements of said second type.

According to another disclosed class of innovative embodiments, there is provided: A rotary-cutter rock-penetrating drill bit, comprising: a plurality of rotatable elements, each bearing thereon first and second pluralities of inserted cutting elements which incrementally remove rock as the drill bit is rotated and advanced; wherein at least some of said first and second cutting elements remove rock from a shared location, and wherein said first and second inserted cutting elements have different diameters.

According to another disclosed class of innovative embodiments, there is provided: A rotary-cutter rock-penetrating drill bit, comprising: a plurality of rotatable elements, each bearing thereon first and second pluralities of inserted cutting elements which incrementally remove rock as the drill bit is rotated and advanced; wherein at least some of said first and second cutting elements remove rock from a shared location, and wherein said first and second inserted cutting elements have different material compositions.

According to another disclosed class of innovative embodiments, there is provided: A method for rotary drilling, comprising the actions of: applying torque and downhole force to a weight-on-bit to a bit as described in one of the six preceding paragraphs, while pumping drilling fluid through a drill string to which said bit is connected.

According to another disclosed class of innovative embodiments, there is provided: A rotary drilling system, comprising: a bit as described in one of the seven preceding paragraphs, a drill string which is connected to conduct drilling fluid to said bit from a surface location; and a rotary drive which rotates at feast part of said drill string together with said bit.

According to another disclosed class of innovative embodiments, there is provided: A cutter for a roller-cone-type rock-penetrating drill bit, comprising: a tapered cutter body bearing a gage row, and at least one other row of cutting elements; wherein said other row includes first and second different types of said cutting elements, wherein said first type is more axisymmetric than said second type.

According to another disclosed class of innovative embodiments, there is provided: A cutter for a roller-cone-type rock-penetrating drill bit, comprising: a tapered cutter body bearing a gage row, and at least one other row of cutting elements; wherein said other row includes first and second different types of said cutting elements, wherein said first type has a larger diameter than said second type.

According to another disclosed class of innovative embodiments, there is provided: A cutter for a roller-cone-type rock-penetrating drill bit, comprising: a tapered cutter body bearing a gage row, and at least one other row of cutting elements; wherein said other row includes first and second different types of said cutting elements, wherein said first type protrudes higher from said body than does said second type.

According to another disclosed class of innovative embodiments, there is provided: A cutter for a roller-cone-type rock-penetrating drill bit, comprising: a cutter body bearing a gage row, and at least one other row of cutting elements; wherein said other row includes first and second different types of said cutting elements, wherein said first type and said second type have different cermet compositions.

Modifications and Variations

As will be recognized by those skilled in the art, the innovative concepts described in the present application can be modified and varied over a tremendous range of applications, and accordingly the scope of patented subject matter is not limited by any of the specific exemplary teachings given. Some contemplated modifications and variations are listed below, but this brief list does not imply that any other embodiments or modifications are or are not foreseen or foreseeable.

In various embodiments, various ones of the disclosed inventions can be applied not only to bits for drilling oil and gas wells, but can also be adapted to other rotary drilling applications (especially deep drilling applications, such as geothermal, geomethane, or geophysical research).

In various embodiments, various ones of the disclosed inventions can be applied not only to pure drill bits (as illustrated), but also to other roller-cone-type rock-removal machines, such as hole reamers, coring bits, or even to large tunnel-boring machines.

In various embodiments, various ones of the disclosed inventions can also be applied to air-cooled mining-type drill bits.

In various embodiments, various ones of the disclosed inventions can be applied not only to top-driven and table-driven configurations, but can also be applied to other rotary drilling configurations, such as motor drive.

In a less preferred class of alternative embodiments, the many proposed variations in tooth type can also be applied to milled cutters.

In another class of alternative embodiments, the many proposed variations in tooth type can also be implemented with a matrix cone structure in which the varying tooth types are formed integrally with the cermet cone.

In many of the embodiments described above, the gage row itself does not include multiple types of insert. However, in other embodiments, different types of teeth can be combined in the gage row too (and preferably also in the driver row and/or other non-gage rows). Insert selection in the gage row is somewhat more constrained than elsewhere, because of the need to trim the gage surface as well as the hole bottom; but subject to this constraint, the disclosed innovations can also be adapted to gage row design.

In another class of embodiments, the same bottomhole track is attacked by inserts of different diameters. (For example, a single non-gage row of a single cone can include inserts of different diameters.)

In another class of embodiments, the same bottomhole track is attacked by inserts of different heights. (For example, a single non-gage row of a single cone can include inserts which protrude upward to different heights.) This can advantageously be implemented, for example, using larger-diameter inserts for the ones which have greater protrusion from the cone.

In another class of embodiments, the same bottomhole track is attacked by inserts of different materials. (For example, a single row of a single cone can include inserts with different carbide compositions.) One particularly advantageous implementation of this is to combine different carbide compositions with different profiles, so that the inserts with the more "aggressive" profile have a more abrasion-resistant composition, and the inserts with a more "conservative" profile have a more fracture-resistant composition. (Another advantageous implementation is just the opposite, where the inserts with the more "aggressive" profile have a more fracture-resistant composition, and the inserts with a more "conservative" profile have a more abrasion-resistant composition.)

Additional general background on drilling, which helps to show the knowledge of those skilled in the art regarding implementation options and the predictability of variations, may be found in the following publications, all of which are hereby incorporated by reference: Baker, A PRIMER OF OILWELL DRILLING (5.ed. 1996); Bourgoyne et al., APPLIED DRILLING ENGINEERING (1991); Davenport, HANDBOOK OF DRILLING PRACTICES (1984); DRILLING (Australian Drilling Industry Training Committee 1997); FUNDAMENTALS OF ROTARY DRILLING (ed. W. W. Moore 1981); Harris, DEEPWATER FLOATING DRILLING OPERATIONS (1972); Maurer, ADVANCED DRILLING TECHNIQUES (1980); Nguyen, OIL AND GAS FIELD DEVELOPMENT TECHNIQUES: DRILLING (1996 translation of 1993 French original); Rabia, OILWELL DRILLING ENGINEERING/PRINCIPLES AND PRACTICE (1985); Short, INTRODUCTION TO DIRECTIONAL AND HORIZONTAL DRILLING (1993); Short, PREVENTION, FISHING & REPAIR (1995); UNDERBALANCED DRILLING MANUAL (Gas Research Institute 1997); the entire PetEx Rotary Drilling Series edited by Charles Kirkley, especially the volumes entitled MAKING HOLE (1983), DRILLING MUD (1984), and THE BIT (by Kate Van Dyke, 4.ed. 1995); the SPE reprint volumes entitled "Drilling," "Horizontal Drilling," and "Coiled-Tubing Technology"; and the Proceedings of the annual IADC/SPE Drilling Conferences from 1990 to date; all of which are hereby incorporated by reference.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

The claims as filed are intended to be as comprehensive as possible, and NO subject matter is intentionally relinquished, dedicated, or abandoned.

What is claimed is:

1. A rotary-cutter rock-penetrating drill bit, comprising:

a plurality of rotatable elements, each bearing thereon first and second pluralities of inserted cutting elements which incrementally remove rock as the drill bit is rotated and advanced;

wherein at least some of said first and second cutting elements remove rock from a shared location;

wherein said first and second inserted cutting elements have different diameters, and wherein at least one single non-gage row of inserts on at least one rotatable element includes ones of said first and ones of said second cutting elements.

2. The bit of claim 1, where said rotatable elements are attached through a rotary joint to arms which are affixed to a body having an API thread.

3. The bit of claim 1, comprising only three of said rotatable elements.

4. A method for rotary drilling, comprising the actions of:

(a). applying torque and axial force to a bit according to claim 1, while (b). pumping drilling fluid through a drill string to which said bit is connected.

5. A rotary drilling system, comprising:

a bit according to claim 1, a drill string which is connected to conduct drilling fluid to said bit from a surface location; and a rotary drive which rotates at least part of said drill string together with said bit.

6. A cutter for a roller-cone-type rock-penetrating drill bit, comprising:

a tapered cutter body bearing a gage row, and at least one other non-gage row of cutting elements;

wherein said other row includes a single row of first and second different types of said cutting elements, wherein said first type has a larger diameter than said second type.

7. The cutter of claim 6, wherein said body is steel, and said cutting elements are cermet inserts.

* * * * *